United States Patent [19]

Koch

[11] 3,974,563

[45] Aug. 17, 1976

[54] SCISSORS, PARTICULARLY HOUSEHOLD- OR TAILOR-SCISSORS

[75] Inventor: Ulf Koch, Solingen, Germany

[73] Assignee: J.A. Henckels Zwillingswerk Aktiengesellschaft, Solingen, Germany

[22] Filed: Feb. 17, 1976

[21] Appl. No.: 658,732

[30] Foreign Application Priority Data

Mar. 20, 1975 Germany ..... 2512188

[52] U.S. Cl. ..... 30/341; 30/260

[51] Int. Cl.[2] ..... B26B 13/04

[58] Field of Search ..... 30/254, 256, 260, 257, 30/261, 341, 255

[56] References Cited

UNITED STATES PATENTS

| | | | |
|---|---|---|---|
| 2,852,846 | 9/1958 | Ahlbin | 30/341 |
| 2,939,213 | 6/1960 | Daniel | 30/260 |
| 3,711,950 | 1/1973 | Students | 30/341 |
| 3,840,990 | 10/1974 | Laurenti | 30/341 |
| 3,894,336 | 7/1975 | Desimone | 30/341 |
| 3,906,630 | 9/1975 | Megna | 30/260 |

*Primary Examiner*—Al Lawrence Smith
*Assistant Examiner*—J. C. Peters
*Attorney, Agent, or Firm*—Martin A. Farber

[57] ABSTRACT

A scissors, particularly a household- or tailor- scissors, including eyes made of synthetic material or the like arranged on handles thereof, including forks formed on the handles, the forks each defining an outwardly directed fork opening, and eye rings insertable in the forks, respectively, in the fork openings, respectively, on the handles.

7 Claims, 5 Drawing Figures z
z
V
V

SCISSORS, PARTICULARLY HOUSEHOLD- OR TAILOR-SCISSORS

The invention relates to a scissors, particularly household- or tailor- scissors, with eyes made of synthetic material or the like arranged on the handles.

It is an object of the invention, particularly, additionally to the objects which may be gathered from the specification and claims, to provide a scissors of the above mentioned type of commercial technical production advantageous, cost-savings construction, in which the eyes, which are arranged on the handles permit high service or operative forces to be received without damage.

It is still another object of the invention to solve the above mentioned object by forming the eyes from rings which are inserted in outwardly opened fork openings of the handles.

As a consequence of such formation, a scissors of the introductory mentioned type is provided which is characterized by an inexpensive cost-savings manufacture of stable construction. The eyes do not need to be attached during the manufacture of the scissor blades and handles. The free end of the handles is simply to be formed with a fork opening. These outwardly-opening fork openings on the one hand most favorably permit the securing of the rings, and on the other hand high operating forces which act on the eyes are unable to move the eyes from their mounting. The operating forces which are exerted on the eyes act in the direction of securing of the eyes to the handles and are caught or absorbed by the fork opening. The width of the metal band or billet from which the scissor beck is punched out can be considerably narrower, so that a substantial material reduction and savings occurs.

An advantageous embodiment in accordance with the present invention resides in a construction in which the eye ring snaps-into the fork opening. This fastening is most simply provided. It can indeed be achieved without the use of tools. As has been found, such a snap connection suffices since the loading forces which act on the eyes are not directed opposite to the spring biased catch or locking force. Over corresponding barbs also an irreversible snap connection is provided.

In accordance with the invention it is advantageous to form the eye ring with an annular or ring groove extending over a part of its periphery, which groove serves for the insertion therein of the fork prongs of the handles. The fork prongs can be inserted or set completely into this ring groove. Thereby no disturbing projections are present which could otherwise stick-out beyond the eye rings, and which bestows to the scissor also an optically advantageous or aesthetically pleasing appearance or impression. The ring groove of the eye ring, which groove is adjusted to the fork prongs, also prevents a distortion or twisting of the eye ring with respect to the fork opening.

A further advantageous feature of the present invention resides in that the ring groove and the fork prongs extend over more that half of the circumferential extent or length of the eye rings. By this measure the resilient biased catch locking force is set or determined. The larger the circumferential extent of the fork prongs and the ring groove is selected, the larger is the resilient biasing catch locking force. The most different synthetic or plastic materials or the like can be employed. It is indeed possible to use a suitable wooden material for the eye rings. The woodwork character of the wood (i.e., with pores naturally occurring therein) can thereby be compensated by a correspondingly designed spring biasing catch connection.

Moreover, in accordance with the present invention, it has proved advantageous to arrange the ring groove laterally off-set relative to the longitudinal center plane of the eye ring by approximately the material thickness of a handle. In this manner the eye rings can be formed mutually alike. This leads to reduced production costs and brings further advantages in the bearing mounting. By this lateral displacement or off-setting, the eye rings lie in the same plane when inserted into the prong openings of the two handles, respectively. Also by this lateral displacement it is not necessary to crank or bend the handles at right angles in order to insure that the end sections of the handles lie in the same plane. This likewise brings about advantages in production.

Still further in accordance with the invention it is yet advantageous to make the depth of the eye rings greater than double the material thickness of the handles. The finger of the operating hand in this manner obtains a larger surface arrangement, such that the eyes do not unpleasantly press into the skin of the operating finger in the event of larger operating forces. Moreover, one attains a stable securing or holding of the eye rings on the handles by this design of the eyes.

With the above and other objects and advantages in view, the present invention will become more clearly understood from the following detailed description of a preferred embodiment of the invention when considered with the accompanying drawings of which:

Figures 1, 2, 3, 4, 5:
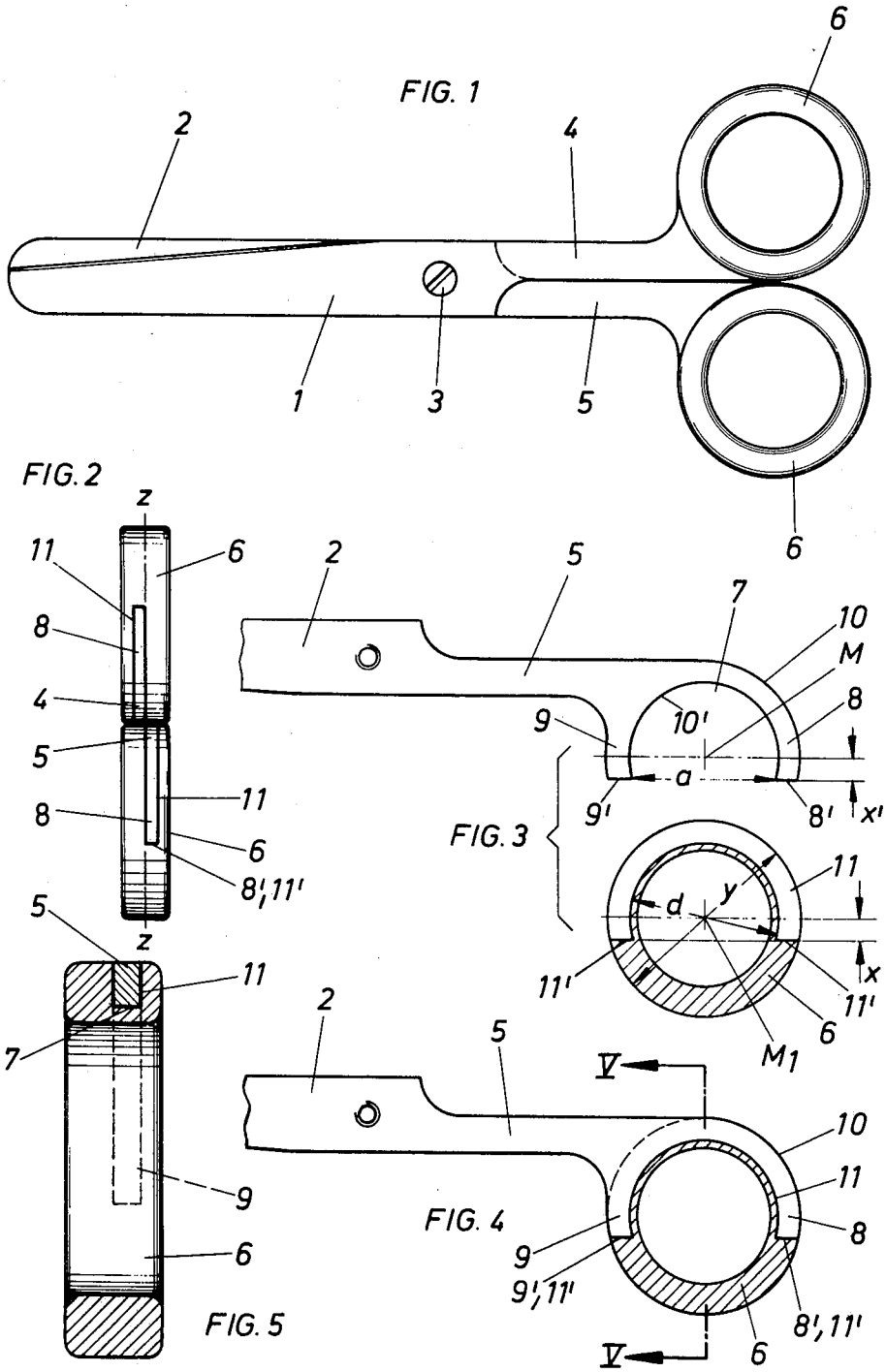
FIG. 1 is a plan view of a scissor of the invention.
FIG. 2 is a flapped figure side view of the right side of FIG. 1.
FIG. 3 is a longitudinal section of the eye ring in exploded view in position for insertion into one of the scissor handles shown in plan view and partly broken away illustrating the fork opening of the handle.
FIG. 4 is a view similar to FIG. 3, however showing the eye ring snapped into the fork opening.
FIG. 5 is an enlarged sectional view taken along the lines V—V of FIG. 4.

Referring now to the drawings, the scissors of the invention comprises like-shaped scissor blades 1 and 2, which are pivotally connected with each other by a so called commercial bolt or a threaded stud 3.

The scissor blades 1, 2 continue on the other of the bolt 3 in a blade arm or handle portion 4, 5, respectively. The latter are not cranked or off-set with respect to the scissor blades, but rather extend in the same plane as the blades. This means that the handle arms (handles) 4 and 5 lie parallel adjacent to each other planarly contacting at opposite facing edges, compare particularly FIG. 2.

The handles 4, 5 are terminally equipped or fastened with eye rings 6. The eye rings, in accordance with the embodiment example, are most suitably made out of synthetic or plastic material and are mutually formed alike.

The opposite disposed handles 4, 5 have terminal outwardly opening fork-openings 7 which are formed by fork prongs 8, 9. The outer contour 10 of the forks and the inner contour 10' of the fork openings 7 are formed centrally or concentric to the center point or origin M. The ring 6 is inserted in the fork opening 7. This ring 6 is formed with a ring groove 11. The latter is central or concentric to the center point of origin $M_1$ of the ring and extends over more than half of the peripheral length of the ring, i.e., it covers an extent of more than 180°. This means that the end edges 11' of the ring or annular groove 11 lie off-set with respect to the center line of the ring 6 by the amount $x$. Likewise the ends 8' and 9' of the prongs of the fork are arranged off-set by the amount $x$ with respect to the center line.

The outer contour 10 of the prongs of the forks are adjusted or complementary to the outer diameter $y$ of the eye-ring 6 so as to be flush therewith, and the diameter $d$ of the base of the ring groove 11 is adjusted complementary to the contour 10' of the fork opening 7.

As may be seen clearly in FIG. 2, the annular groove 11 is arranged latterally off-set relative to the longitudinal center plane $z$—$z$ of the eye rings 6 by an amount substantially equal to the material thickness of a handle.

The fastening of the eye-rings 6 on the handles 4, 5 takes place by a snap-in engagement therewith since the opening or inner width $a$ between the ends 8' and 9' (constituting barbs) of the fork prongs is smaller than the diameter $d$ of the base of the ring groove 11. The eye-rings 6 thus are snapped into the fork openings 7 of the handles 4 and 5, respectively, such that both superimposed rings 6 lying upon each other, then accordingly extend in the same plane (compare FIG. 2).

Since the outer contour of the prongs 8 and 9 of the forks is adjusted to the outer contour of the eye-rings 6, in the range of the eye-rings 6 no disturbing jutting-out projections occur. The eye-rings 6 transfer continuously into the course of the handle arms 4 and 5.

From FIG. 5 it may be recognized that the depth or height of the eye-rings 6 amounts to more than double the material thickness of the handles 4 and 5.

While I have disclosed one embodiment of the invention, it is to be understood that this embodiment is given by example only and not in a limiting sense.

I claim:

1. A scissors, particularly a household- or tailor-scissors, including eyes made of synthetic material or the like arranged on handles thereof, comprising two pivotally connected members having handles, respectively, said handles are formed with forks, respectively, having prongs defining an outwardly directed fork opening on each of said handles, eye rings insertable in said forks, respectively, in said fork openings, respectively, of said handles.

2. The scissors, as set forth in claim 1, wherein said eye rings and said forks, respectively, constitute snap engagement means for snapping said eye rings into said fork openings.

3. The scissors, as set forth in claim 1, wherein said eye rings are formed with annular grooves extending over a part of the periphery of said eye rings, respectively, said prongs of said forks of said handles, respectively, are inserted in said annular grooves, respectively, of said eye rings.

4. The scissors, as set forth in claim 1, wherein said annular grooves and said prongs extend over more than half of the peripheral length of said eye rings, respectively, providing a secure fastening of said eye rings in said fork openings.

5. The scissors, as set forth in claim 1, wherein said annular grooves are laterally off-set relative to a longitudinal center plane of said eye rings, respectively, by an amount substantially equal to the thickness of said handles, respectively.

6. The scissors, as set forth in claim 1, wherein the level of said eye rings is greater that double the thickness of said handles.

7. The scissors, as set forth in claim 1, wherein said prongs of said handles, respectively, point in directions laterally opposite from each other and perpendicularly to a longitudinal axis of said members, respectively, said members each include a cutting blade which is coplanar with a corresponding of said forks.

* * * * *